US009690225B2

(12) United States Patent
Yoshioka

(10) Patent No.: US 9,690,225 B2
(45) Date of Patent: Jun. 27, 2017

(54) IMAGE FORMING APPARATUS AND METHOD

(71) Applicant: FUJI XEROX CO., LTD., Tokyo (JP)

(72) Inventor: Tomoaki Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/836,085

(22) Filed: Aug. 26, 2015

(65) Prior Publication Data

US 2016/0266525 A1 Sep. 15, 2016

(30) Foreign Application Priority Data

Mar. 10, 2015 (JP) ..... 2015-047238

(51) Int. Cl.

| | |
|---|---|
| ***G03G 15/16*** | (2006.01) |
| ***G03G 15/01*** | (2006.01) |
| ***G03G 15/02*** | (2006.01) |
| *G03G 15/00* | (2006.01) |

(52) U.S. Cl.

CPC ..... *G03G 15/0157* (2013.01); *G03G 15/0266* (2013.01); *G03G 15/169* (2013.01); *G03G 15/1645* (2013.01); *G03G 15/1675* (2013.01); *G03G 15/0189* (2013.01); *G03G 15/6582* (2013.01)

(58) Field of Classification Search

CPC ..... G03G 15/0157; G03G 15/0189; G03G 15/0266; G03G 15/0291; G03G 15/169

USPC ..... 399/296, 302

See application file for complete search history.

(56) References Cited

U.S. PATENT DOCUMENTS

| | | | | |
|---|---|---|---|---|
| 5,579,100 A * | 11/1996 | Yu | G03G 15/0157 | 399/171 |
| 5,862,432 A * | 1/1999 | Nakayama | G03G 21/0005 | 399/129 |
| 2005/0141929 A1* | 6/2005 | Mochizuki | G03G 15/1675 | 399/298 |

FOREIGN PATENT DOCUMENTS

| | | |
|---|---|---|
| JP | 2006-330437 A | 12/2006 |
| JP | 2008-15480 A | 1/2008 |

* cited by examiner

*Primary Examiner* — Benjamin Schmitt
(74) *Attorney, Agent, or Firm* — Sughrue Mion, PLLC

(57) ABSTRACT

An image forming apparatus includes the following elements. Plural developing units supply charged developers to electrostatic latent images formed on plural associated image carriers disposed along a direction in which an intermediate transfer body is transported. Plural first transfer units transfer the associated developers onto the intermediate transfer body when the intermediate transfer body passes the associated image carriers while being transported so as to superpose the developers on each other. A second transfer unit transfers the superposed developers transferred onto the intermediate transfer body by the plural first transfer units onto a recording medium. A charge-amount adjusting unit decreases an amount of electric charge of a developer which forms a lower layer developer among the superposed developers transferred onto the intermediate transfer body. A brightness level of the lower layer developer is lower than that of a developer which forms an upper layer developer among the superposed developers.

19 Claims, 8 Drawing Sheets

* BRIGHTNESS VALUE OF K IS 0 AND IS NOT SUBJECTED TO ELECTRIC CHARGE ADJUSTMENT

IMAGE FORMING APPARATUS AND METHOD

CROSS-REFERENCE TO RELATED APPLICATIONS

This application is based on and claims priority under 35 USC 119 from Japanese Patent Application No. 2015-047238 filed Mar. 10, 2015.

BACKGROUND

Technical Field

The present invention relates to an image forming apparatus and method.

SUMMARY

According to an aspect of the invention, there is provided an image forming apparatus including the following elements. Plural developing units supply charged developers to electrostatic latent images formed on plural associated image carriers which are disposed along a direction in which an intermediate transfer body is transported. Plural first transfer units transfer the associated developers onto the intermediate transfer body when the intermediate transfer body passes the associated image carriers while being transported so as to superpose the developers on each other. A second transfer unit transfers the superposed developers which are transferred onto the intermediate transfer body by the plural first transfer units onto a recording medium. A charge-amount adjusting unit decreases an amount of electric charge of a developer which forms a lower layer developer among the superposed developers transferred onto the intermediate transfer body by the first transfer units. A brightness level of the lower layer developer is lower than that of a developer which forms an upper layer developer among the superposed developers.

BRIEF DESCRIPTION OF THE DRAWINGS

An exemplary embodiment of the present invention will be described in detail based on the following figures, wherein:

FIG. 5A is a paper type—output level characteristic diagram, FIG. 5B is a humidity—output level characteristic diagram, and FIG. 5C is a first-transfer-roller resistance value—output level characteristic diagram;

DETAILED DESCRIPTION (Overview of Image Forming Apparatus 10)

Figure 1:
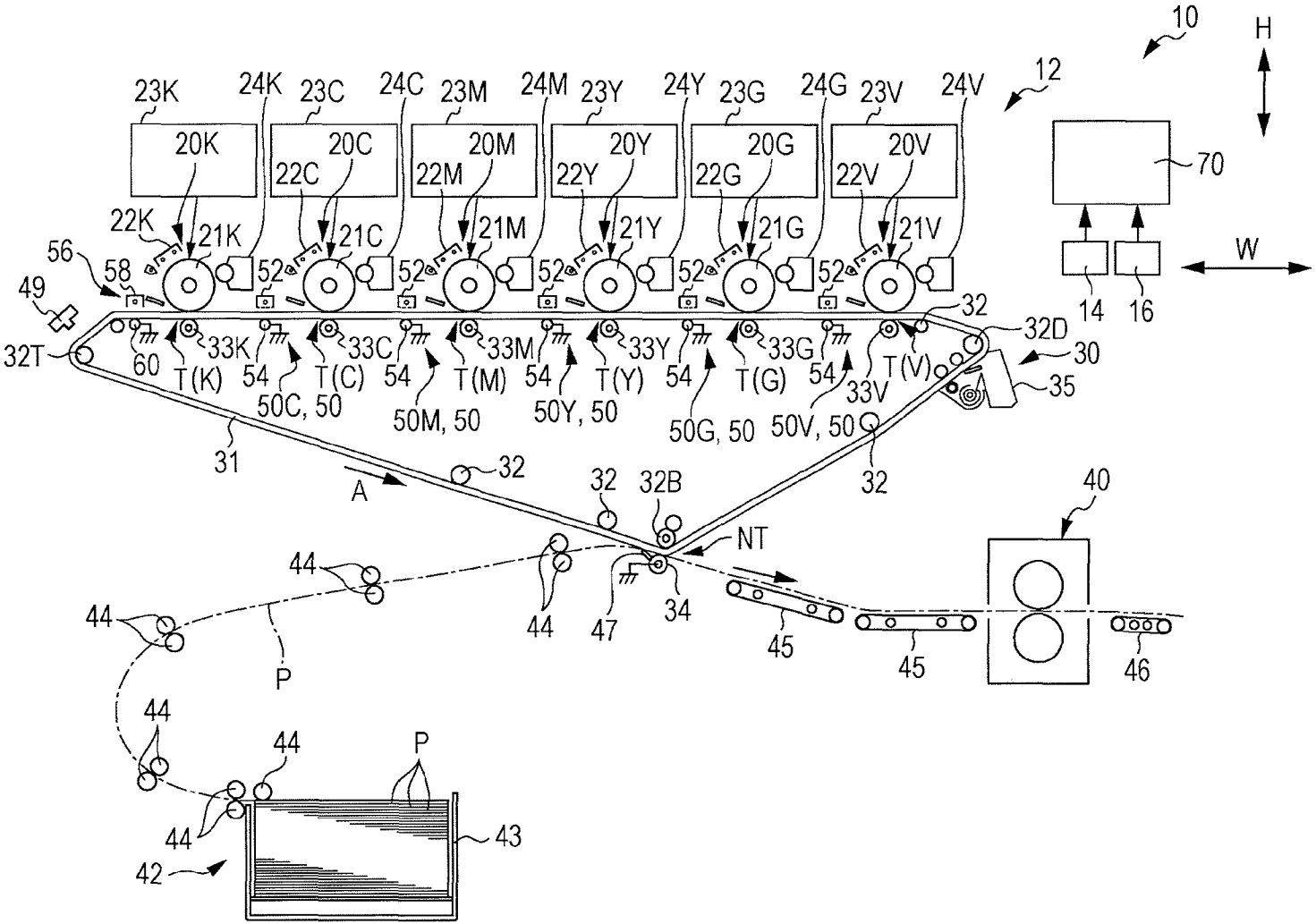
FIG. 1 is a schematic front view of an image forming apparatus according to an exemplary embodiment.

FIG. 1 illustrates an image forming apparatus 10 according to an exemplary embodiment of the invention. The arrow H shown in FIG. 1 indicates the vertical direction, while the arrow W indicates the horizontal direction, which corresponds to the widthwise direction of the image forming apparatus 10.

As shown in FIG. 1, the image forming apparatus 10 includes a body 12, a transport device 42, and a controller 70. The body 12 forms an image on a recording medium P, such as a sheet of paper, according to an electrophotographic system. The transport device 42 transports the recording medium P. The controller 70 controls operations of individual elements of the image forming apparatus 10.

In the image forming apparatus 10, a temperature sensor 14 and a humidity sensor 16 are provided for respectively detecting the temperature and the humidity around the body 12. The temperature sensor 14 and the humidity sensor 16 are connected to the controller 70. The controller 70 may correct various items of data (including the output levels of first charge-amount adjusting devices 50, which will be discussed later) for performing image forming processing, on the basis of information concerning the temperature and the humidity detected by the temperature sensor 14 and the humidity sensor 16, respectively. The humidity may be calculated by converting the temperature detected by the temperature sensor 14.

As shown in FIG. 1, the transport device 42 includes a storage unit 43, plural transport rollers 44, and transport belts 45 and 46. Within the storage unit 43, recording mediums P are stored. The transport rollers 44 and the transport belts 45 and 46 are disposed along a transport path through which recording mediums P are supplied from the storage unit 43 and are discharged via a second transfer position NT and a fixing device 40.

The body 12 includes plural toner image forming units 20 that form toner images of individual colors.

In this exemplary embodiment, from the upstream side to the downstream side, a total of six toner image forming units 20 for forming toner images of a first special color (violet "V"), a second special color (green "G"), and regular colors (yellow "Y", magenta "M", cyan "C", and black "K") are sequentially disposed. In FIG. 1, the toner image forming units 20 are distinguished from each other by reference numerals 20V, 20G, 20Y, 20M, 20C, and 20K, respectively. The toner image forming units 20 have the same structure, and thus, hereinafter, they may be simply referred to as the "image forming unit 20" or "image forming units 20" if it is not necessary to distinguish them from each other.

In addition to the toner image forming units 20, the body 12 includes a transfer device 30 and a fixing device 40. The transfer device 30 transfers toner images formed by the toner image forming units 20 onto a recording medium P. The fixing device 40 heats and pressurizes toner images transferred onto a recording medium P so as to fix them on the recording medium P.

The toner image forming units 20 are basically configured similarly, except for toner to be used. More specifically, each of the toner image forming units 20 includes a photoconductor drum 21, a charging device 22, an exposure device 23, and a developing device 24. The photoconductor drum 21, which is an example of an image carrier, rotates clockwise in FIG. 1. The charging device 22 charges the photoconductor drum 21. The exposure device 23 exposes the charged photoconductor drum 21 to light so as to form an electrostatic latent image on the photoconductor drum 21. The developing device 24, which is an example of a developing unit, develops an electrostatic latent image formed on the photoconductor drum 21 so as to form a toner image.

The transfer device 30 transfers toner images formed on the photoconductor drums 21 onto an intermediate transfer belt 31, which is an example of an intermediate transfer body, at first transfer positions T (first transfer) so as to superpose the toner images on each other. The transfer device 30 then transfers the superposed toner images onto a recording medium P at the second transfer position NT (second transfer). The intermediate transfer body may be a drum type (intermediate transfer drum).

More specifically, as shown in FIG. 1, the transfer device 30 includes the intermediate transfer belt 31, first transfer rollers 33, each of which serves as a first transfer unit, a second transfer roller 34, which serves as a second transfer unit, a cleaning device 47 for cleaning the second transfer roller 34, and a cleaning device 35 for cleaning the intermediate transfer belt 31.

As shown in FIG. 1, the intermediate transfer belt 31 is formed as an endless belt and is wound and stretched on plural rollers 32. In this manner, the shape of the intermediate transfer belt 31 is fixed.

In this exemplary embodiment, the shape of the intermediate transfer belt 31 is an inverted obtuse-angled triangle extending in the widthwise direction of the image forming apparatus 10, as viewed from the front side thereof. Among the plural rollers 32, a roller 32D shown in FIG. 1 serves as a drive roller which rotates the intermediate transfer belt 31 in the direction indicated by the arrow A by using power supplied from a motor (not shown). The intermediate transfer belt 31 is rotated in the direction indicated by the arrow A so as to transport toner images transferred from the photoconductor drums 21 to the second transfer position NT.

Among the plural rollers 32, a roller 32T shown in FIG. 1 serves as a tension applying roller which applies tension to the intermediate transfer belt 31. A roller 32B serves as an opposing roller which opposes the second transfer roller 34. The bottom vertex portion of the intermediate transfer belt 31 which forms an obtuse angle of the inverted obtuse-angled triangle is wound and stretched on the opposing roller 32B. The intermediate transfer belt 31 contacts the photoconductor drums 21 from downward at the top side of the inverted obtuse-angled triangle extending in the widthwise direction of the image forming apparatus 10.

The first transfer rollers 33 are rollers which transfer toner images formed on the photoconductor drums 21 onto the intermediate transfer belt 31. Toner images are images developed as a result of supplying toner, which is an example of a developer, to the photoconductor drums 21. The first transfer rollers 33 are disposed inward of the intermediate transfer belt 31 such that they oppose the associated colors of the photoconductor drums 21 with the intermediate transfer belt 31 therebetween. A first transfer voltage of the polarity opposite to the polarity of toner is applied to the first transfer rollers 33 by a power supply unit (not shown). By the application of the first transfer voltage, toner images formed on the photoconductor drums 21 are transferred onto the intermediate transfer belt 31 at the first transfer positions T.

The second transfer roller 34 is a roller which transfers toner images superposed on the intermediate transfer belt 31 onto a recording medium P. The second transfer roller 34 is disposed such that it opposes the opposing roller 32B with the intermediate transfer belt 31 therebetween. The second transfer roller 34 and the intermediate transfer belt 31 are in contact with each other with a predetermined load.

The position at which the second transfer roller 34 and the intermediate transfer belt 31 contact each other is the second transfer position NT. A recording medium P is supplied from the storage unit 43 to the second transfer position NT at a suitable timing. The second transfer roller 34 is driven and rotated clockwise in FIG. 1. In this exemplary embodiment, even when the second transfer roller 34 and the intermediate transfer belt 31 are separate from each other, the position between the second transfer roller 34 and the intermediate transfer belt 31 is called the second transfer position NT.

The cleaning device 47 is formed as a blade, which serves as a removing member which contacts the rotating second transfer roller 34 so as to remove foreign substances (such as powder of toner and recording mediums P) adhering to the surface of the second transfer roller 34 from the second transfer roller 34.

As shown in FIG. 1, the cleaning device 35 is disposed on the downstream side of the second transfer position NT and on the upstream side of the first transfer position T(V) in the rotating direction of the intermediate transfer belt 31.

(Charge-Amount Adjusting Device)

Toner which is negatively charged (toner charged at a normal polarity) on the photoconductor drum 21 of one color is transferred to the intermediate transfer belt 31 at the first transfer position T. Then, when the toner passes through the first transfer position T of another color on the downstream side, separating discharge is generated, and the amount of electric charge (charge amount) is increased due to this separating discharge.

The amount by which electric charge of toner is increased is proportional to the number of times toner passes through the first transfer positions T. Accordingly, as toner is transferred to the intermediate transfer belt 31 at the first transfer position T on the farther upstream side, the charge amount is increased to a greater level. In other words, the charge amount of toner per gram (μc/g) on the intermediate transfer belt 31 is increased. Such an increase in the charge amount of toner may cause a transfer failure of toner images onto a recording medium P at the second transfer position NT.

For example, an M toner passes through the two first transfer positions T since the C and K toner image forming units 20 are disposed on the farther downstream side after the M toner image forming unit 20. It has been verified by experiment that toner which has passed through the two first transfer positions T is able to maintain the negative polarity and to be properly transferred to a recording medium P at the second transfer position NT.

In contrast, a V toner passes through the five first transfer positions T since the G, Y, M, C, and K toner image forming units 20 are disposed on the farther downstream side after the V toner image forming unit 20. It has been verified by experiment that toner which has passed through the five first transfer positions T is unable to maintain the negative polarity (normal polarity) and fails to be properly transferred to a recording medium P at the second transfer position NT, that is, a transfer failure occurs at the second transfer position NT.

Such a transfer failure of toner may occur depending on the type of toner (particle size of toner having, for example, a mean volume diameter of 5.8 μm or 3.8 μm). For example, if the toner particle size is smaller, for example, if the mean volume diameter is 3.8 μm, the surface area of toner is smaller, and thus, the charge amount of toner is decreased. When a blue (B) image is formed, C is superposed on M. In this case, since the M toner passes through the two first transfer positions T, it may be unable to maintain the negative polarity (normal polarity) and a transfer failure may occur at the second transfer position NT.

If a transfer failure occurs, there may be a case in which such a transfer failure significantly influences the image quality and a case in which it does not significantly influence the image quality, depending on the color (brightness) of toner.

Figure 4:
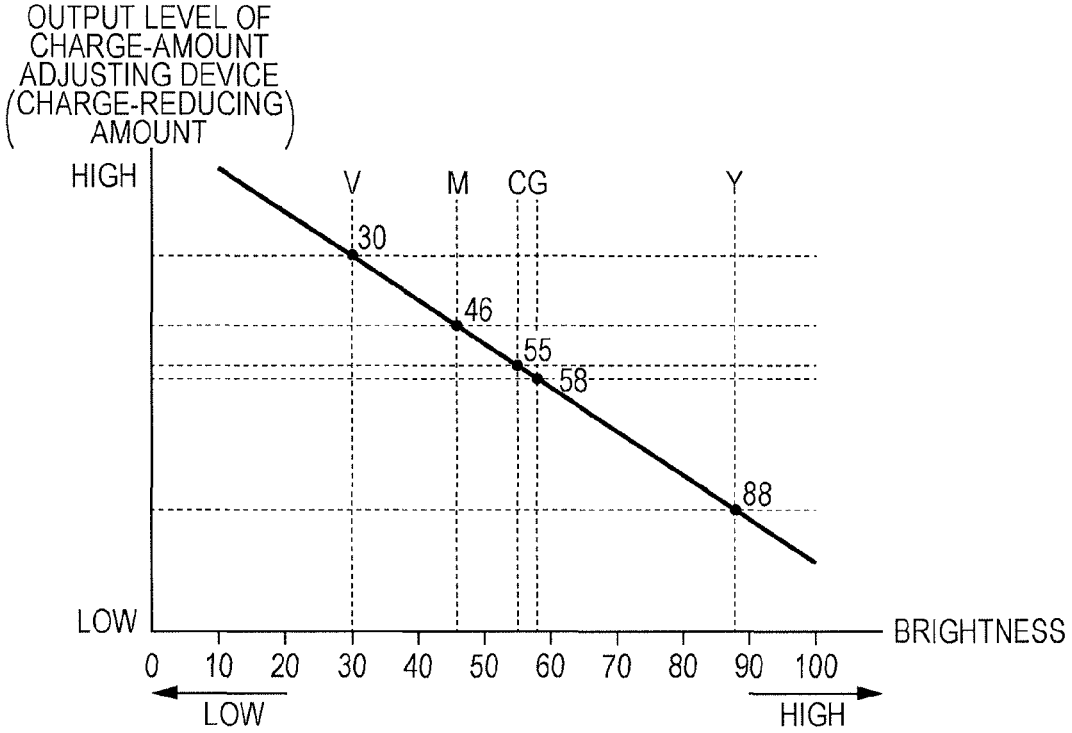
FIG. 4 is a brightness—output level characteristic diagram according to the exemplary embodiment.

For example, as shown in FIG. 4, the brightness level of Y is higher than that of M and C. If the brightness levels of the individual colors are compared with each other in terms of values (as the brightness level is higher, the value is greater), the results are V=30±1, G=58±1, Y=88±1, M=46±1, and C=55±1.

Among the six colors, for the color having the highest brightness level, that is, Y, the visibility is lower than that of the other colors. Accordingly, even if the above-described transfer failure occurs to Y, it is less likely to be recognized. On the other hand, since V and M have a brightness value of 50 or smaller, the visibility is higher, and thus, a transfer failure is more likely to be recognized. In the case of M, this is more noticeable if M has a small toner particle size. Although the brightness values of G and C are 50 or greater, the visibility of G and C is higher than that of Y, and thus, a transfer failure may be recognized if it occurs.

Accordingly, in this exemplary embodiment, first charge-amount adjusting devices 50, each of which is an example of a charge-amount adjusting unit, are disposed such that they oppose the surface of the intermediate transfer belt 31.

The first charge-amount adjusting devices 50 have the function of decreasing the charge amount (charge-reducing function) of toner if the charge amount has reached such a degree as to cause a transfer failure at the second transfer position NT.

The first charge-amount adjusting device 50 is disposed in the downstream vicinity of each of the toner image forming units 20 other than K toner image forming unit 20K. In other words, the first charge-amount adjusting device 50 of each toner image forming unit 20 is disposed on the farther upstream side than the adjacent downstream toner image forming unit 20.

That is, a first charge-amount adjusting device 50V is disposed in the downstream vicinity of the V toner image forming unit 20V. A first charge-amount adjusting device 50G is disposed in the downstream vicinity of the G toner image forming unit 20G. A first charge-amount adjusting device 50Y is disposed in the downstream vicinity of the Y toner image forming unit 20Y. A first charge-amount adjusting device 50M is disposed in the downstream vicinity of the M toner image forming unit 20M. A first charge-amount adjusting device 50C is disposed in the downstream vicinity of the C toner image forming unit 20C.

Figure 2:
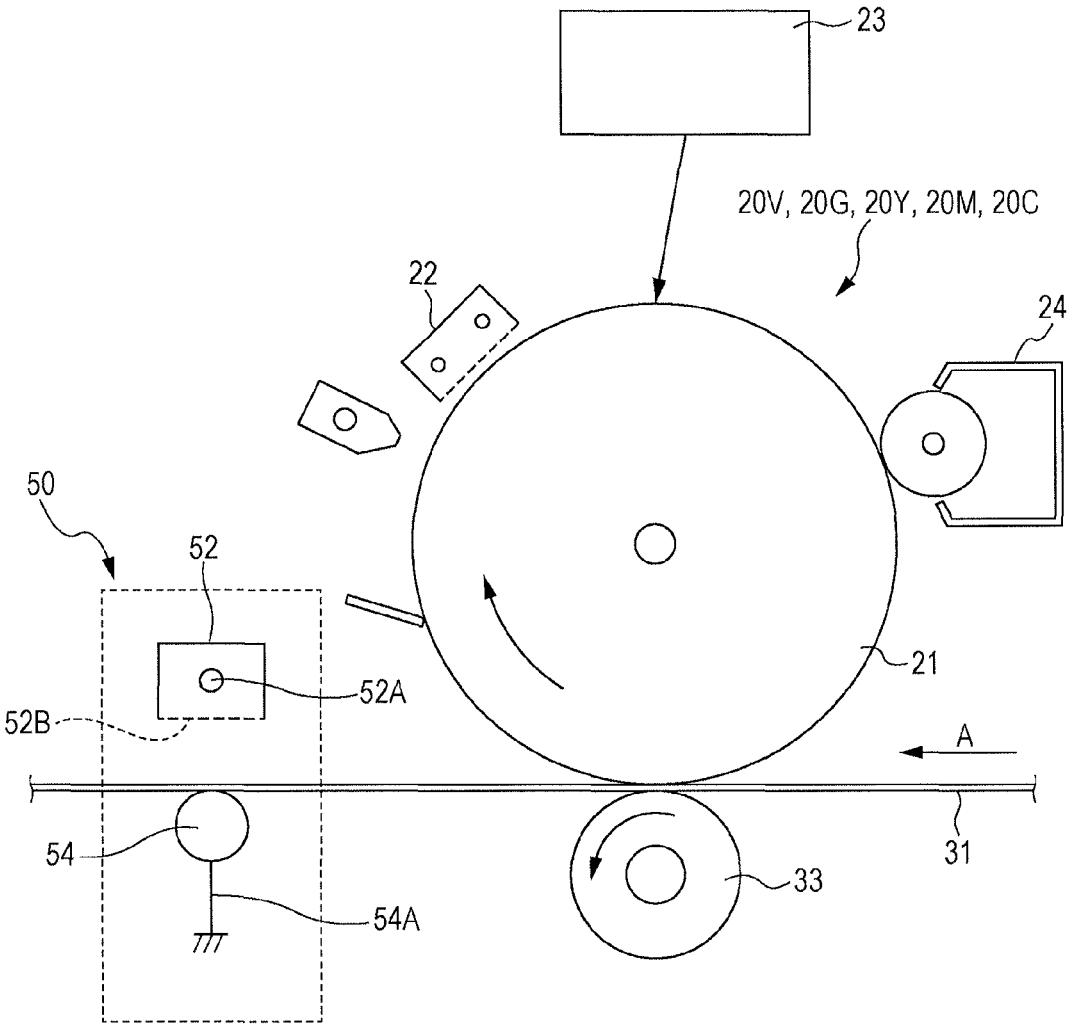
FIG. 2 is an enlarged view of a toner image forming unit according to the exemplary embodiment.

As shown in FIGS. 1 and 2, the first charge-amount adjusting device 50 includes a scorotron 52 and a ground roller 54. The scorotron 52 is an example of a corona discharge member and is disposed on the front side (upper surface in FIGS. 1 and 2) of the intermediate transfer belt 31. The ground roller 54 is an example of a ground member and is disposed on the back side (lower surface in FIGS. 1 and 2) of the intermediate transfer belt 31.

As shown in FIG. 2, the scorotron 52 includes a charge wire 52A and a grid 52B. The ground roller 54 is rotated in accordance with the movement of the intermediate transfer belt 31 and is grounded via a ground line 54A.

The first charge-amount adjusting device 50 has the function of decreasing the charge amount (reducing electric charge) of toner transferred onto the intermediate transfer belt 31. That is, the first charge-amount adjusting device 50 decreases the charge amount of toner by providing electric charge of the polarity (positive) opposite to the normal polarity (negative) of toner to toner.

In contrast, as shown in FIG. 1, unlike the first charge-amount adjusting devices 50 disposed in the downstream vicinities of the toner image forming units 20 other than the K toner image forming unit 20K, a second charge-amount adjusting device 56 is disposed in the downstream vicinity of the K toner image forming unit 20K positioned on the extreme downstream side. The structure of the second charge-amount adjusting device 56 is the same as that of the first charge-amount adjusting devices 50. That is, the second charge-amount adjusting device 56 includes a scorotron 58 and a ground roller 60. However, the second charge-amount adjusting device 56 increases the charge amount of toner by providing electric charge of the same polarity as the normal polarity (negative) of toner to toner.

The second charge-amount adjusting device 56 serves to restore the charge amount of single color toner from which electric charge has been reduced by the first charge-amount adjusting devices 50.

In the first charge-amount adjusting devices 50 disposed in the downstream vicinities of the associated toner image forming units 20, except for the K toner image forming unit 20, the charge-reducing capacities are different from each other.

That is, in this exemplary embodiment, the charge amount to be adjusted (charge-reducing amount) by the first charge-amount adjusting device 50 is set in accordance with the brightness value. More specifically, as shown in FIG. 4, as the brightness value is smaller, the amount by which electric charge is reduced by the first charge-amount adjusting device 50 is set to be greater. Note that the brightness value of K is 0 and is not subjected to the adjustment of electric charge.

Figure 3:
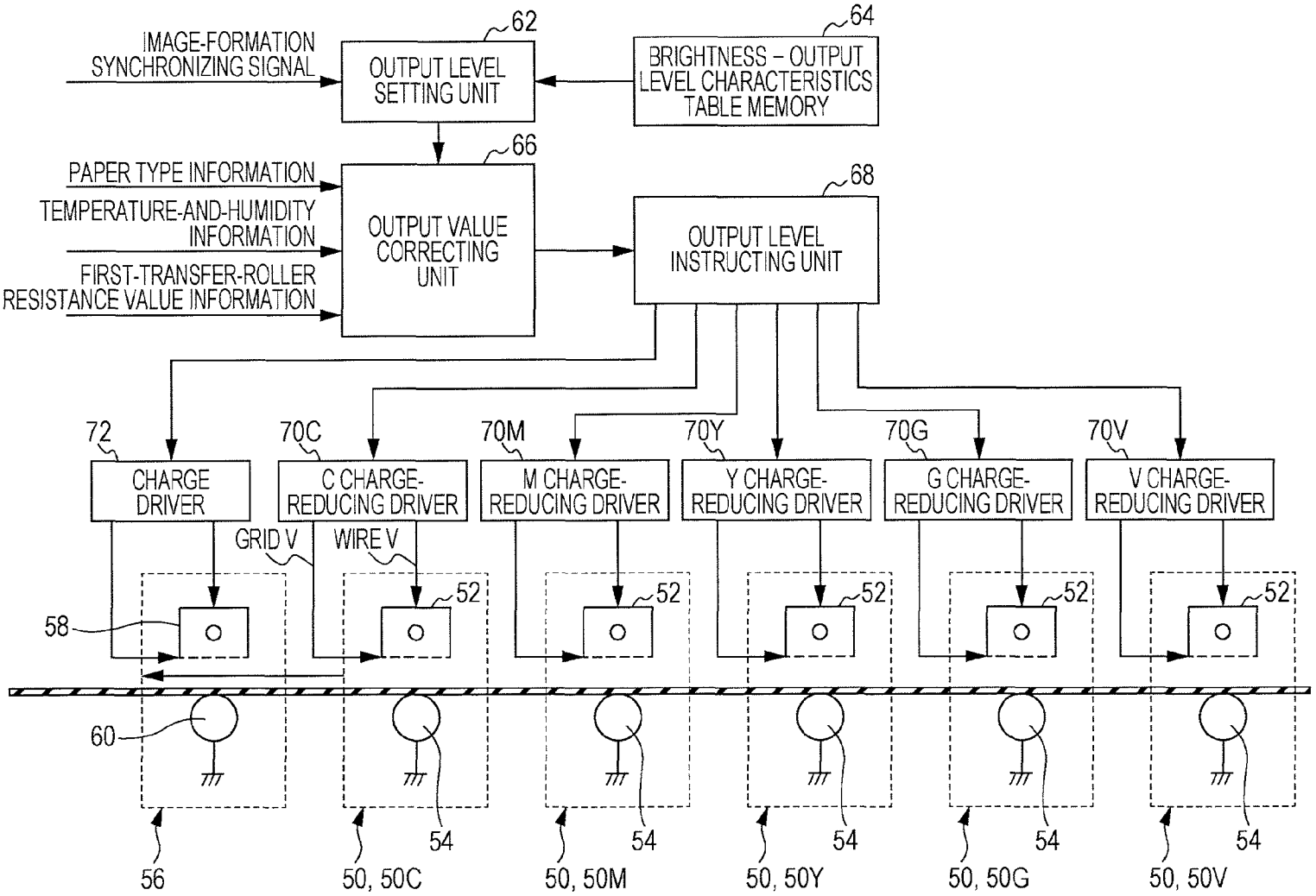
FIG. 3 is a functional block diagram of a controller which performs charge-amount adjusting control by using first and second charge-amount adjusting devices according to the exemplary embodiment.

FIG. 3 is a functional block diagram of the controller 70 which performs charge-amount adjusting control by using the first and second charge-amount adjusting devices 50 and 56. The blocks shown in FIG. 3 do not restrict the hardware configuration of the controller 70.

An image-formation synchronizing signal is input into an output level setting unit 62. In accordance with this image-formation synchronizing signal, the output level setting unit 62 controls the operation timings of the first and second charge-amount adjusting devices 50 and 56.

A brightness—output level characteristic table memory 64 is connected to the output level setting unit 62. The brightness—output level characteristic data shown in FIG. 4 is formed into a table and is stored in the brightness—output level characteristic table memory 64.

Basically, the brightness—output level characteristic data shown in FIG. 4 is fixed once the specifications of the image forming apparatus 10 are determined. However, if maintenance, such as specification changes, replacement of components, and handling of aging deterioration, that may influence image formation, has been conducted, the brightness—output level characteristic table data stored in the brightness—output level characteristic table memory 64 is updated.

The output levels of the first charge-amount adjusting devices 50 (charge-reducing amounts) for toners of the individual colors are identified from the brightness—output level characteristic data shown in FIG. 4. That is, as the brightness value is smaller, the output level (charge-reducing amount) of the first charge-amount adjusting device 50 is higher. In FIG. 4, the characteristic curve is represented by a direct proportional change (linear function). However, the characteristic curve may be represented by a degree n polynomial function (n is two or greater) or may be non-linear as long as the output level (charge-reducing amount) of the first charge-amount adjusting device 50 becomes higher as the brightness value is smaller.

The output level setting unit 62 is connected to an output value correcting unit 66.

Paper type information concerning the paper type of recording medium P to be subjected to image formation, information concerning the temperature and the humidity detected by the temperature sensor 14 and the humidity sensor 16, respectively, shown in FIG. 1, and information concerning the resistance value of the first transfer rollers 33 are input into the output value correcting unit 66 from another control function of the controller 70.

The output value correcting unit 66 corrects the output levels of the first charge-amount adjusting devices 50 of the individual colors which are set by the output level setting unit 62.

(Correction Based on Paper Type Information)

As the surface of a recording medium P is rougher, a stronger stress is produced and toner is more likely to remain on the intermediate transfer belt 31, that is, a transfer failure is more likely to occur. That is, if the surface of a recording medium P is rough, a high second transfer voltage is required, and discharging at the second transfer position NT becomes greater. Accordingly, a suitable charge output level differs according to the paper type.

Figure 5A:
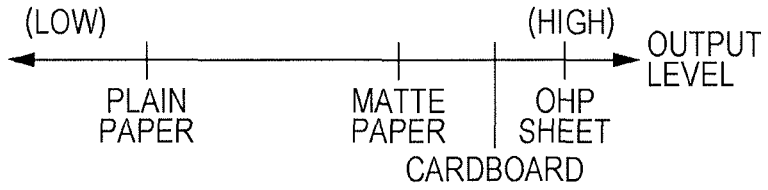
FIGS. 5A through 5C illustrate information for correcting output levels by using the first and second charge-amount adjusting devices according to the exemplary embodiment.

Thus, on the basis of the paper type—output level characteristic diagram shown in FIG. 5A, the output level of the first charge-amount adjusting device 50 is corrected. For example, since the resistance value of cardboard is higher than that of plain paper, the output level for cardboard is set to be higher than that for plain paper. Since the resistance value of OHP sheets is even higher than that of cardboard, the output level for OHP sheets is set to be higher than that for cardboard. The output level of matte paper is set to be an intermediate value between that of cardboard and that of plain paper.

FIG. 5A shows the correlations between the charge output levels for plain paper, cardboard, OHP sheets, and matte paper by way of examples. The output level of another type of paper may be set on the basis of the resistance value and the surface roughness thereof.

(Correction Based on Temperature Information and Humidity Information)

As the humidity is lower, a stronger stress is produced and toner is more likely to remain on the intermediate transfer belt 31, that is, a transfer failure is more likely to occur. Thus, on the basis of the humidity—output level characteristic diagram shown in FIG. 5B, the output level of the first charge-amount adjusting device 50 is corrected.

Figure 5B:
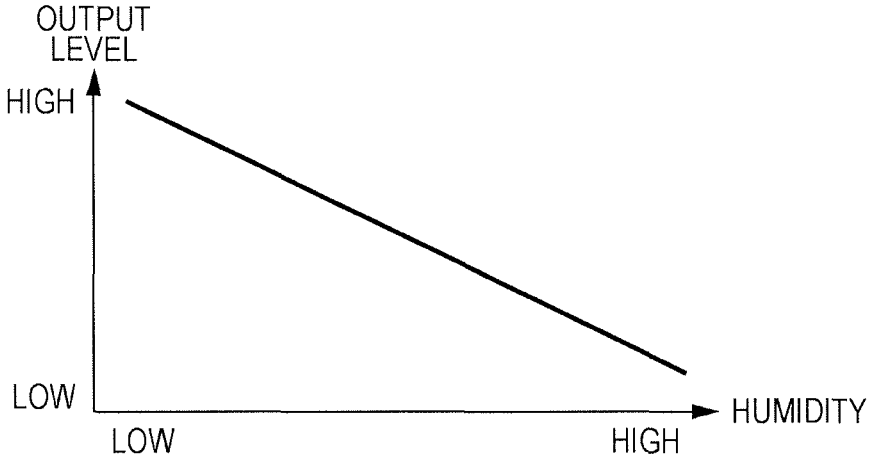

In FIG. 5B, the characteristic curve is represented by a direct proportional change (linear function). However, the characteristic curve may be represented by a degree n polynomial function (n is two or greater) or may be non-linear as long as the output level (charge-reducing amount) of the first charge-amount adjusting device 50 becomes higher as the humidity is lower. The output level of the first charge-amount adjusting device 50 may be corrected in accordance with the temperature in addition to the humidity. For example, the output level (charge-reducing amount) of the first charge-amount adjusting device 50 corrected on the basis of the humidity is further corrected so that it will become higher as the temperature is lower.

(Correction Based on Resistance Value of First Transfer Rollers 33)

At the first transfer positions T, constant current control is performed for the first transfer voltage. Accordingly, as the resistance value of the first transfer rollers 33 is higher, the first transfer voltage is increased. As the first transfer voltage is higher, separating discharge is increased, and accordingly, it is necessary to enhance the charge-reducing function. Thus, on the basis of the first-transfer-roller resistance value—output level characteristic diagram shown in FIG. 5C, the output level of the first charge-amount adjusting device 50 is corrected.

Figure 5C:
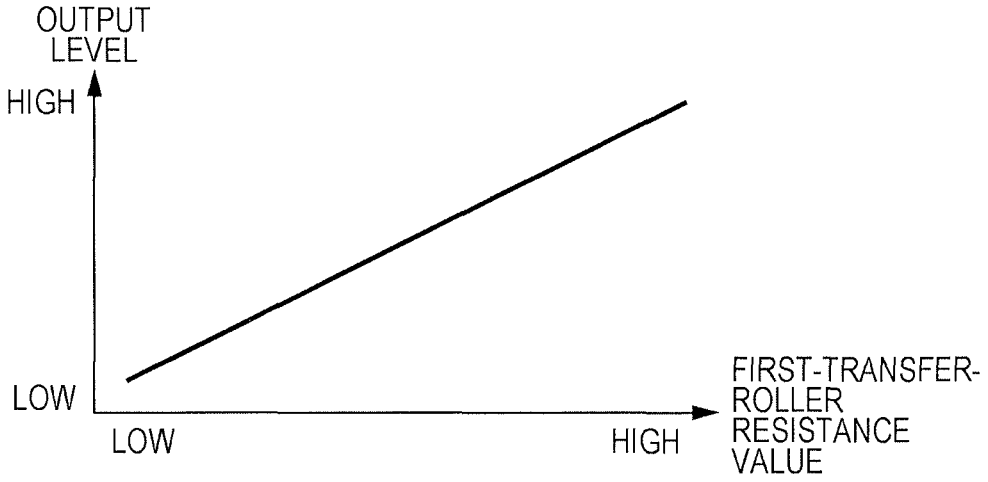

In FIG. 5C, the characteristic curve is represented by a direct proportional change (linear function). However, the characteristic curve may be represented by a degree n polynomial function (n is two or greater) or may be non-linear as long as the output level (charge-reducing amount) of the first charge-amount adjusting device 50 becomes higher as the resistance value of the first transfer rollers 33 is higher.

Referring back to FIG. 3, the output value correcting unit 66 is connected to an output level instructing unit 68. The output value correcting unit 66 supplies the output levels for the individual colors to the output level instructing unit 68 at a timing corresponding to the image-formation synchronizing signal received from the output level setting unit 62.

The output level instructing unit 68 is connected to a V charge-reducing driver 70V, a G charge-reducing driver 70G, a Y charge-reducing driver 70Y, an M charge-reducing driver 70M, and a C charge-reducing driver 70C (they will be collectively referred to as the "color charge reducing driver 70" or the "color charge-reducing drivers 70").

The output level instructing unit 68 instructs the color charge-reducing drivers 70 to operate the associated charge-amount adjusting devices 50 in accordance with the output levels set for the individual colors.

Each color charge-reducing driver 70 applies voltages to the charge wire 52A and the grid 52B of the scorotron 52.

A uniform voltage (for example, 400 V) is applied to the grids 52B of the scorotrons 52.

The voltages applied to the charge wires 52A of the scorotrons 52 are different from each other in accordance with the output levels for the individual colors. For example, V is 7 kV, G is 3.2 kV, Y is 2.5 kV, M is 4.5 kV, and C is 3.5 kV. As shown in FIG. 4, as the brightness level is lower, the voltage to be applied is higher.

In this manner, electric charge of the polarity (positive) opposite to the normal polarity (negative) of toner is provided to toner so as to decrease the charge amount of toner.

A charge driver 72 is also connected to the output level instructing unit 68. The output level instructing unit 68 instructs the charge driver 72 to operate the second charge-amount adjusting device 56 in accordance with a predetermined output level.

The charge driver 72 applies voltages to the charge wire and the grid of the scorotron 58 of the second charge-amount adjusting device 56.

With the application of a voltage to the charge wire, electric charge of the same polarity as the normal polarity (negative) of toner is applied to the toner of the topmost layer among the toners which have been transferred from the photoconductor drums 21 (first transfer) and superposed on the intermediate transfer belt 31 so as to increase the charge amount of toner.

The second charge-amount adjusting device 56 serves to increase a holding force between the intermediate transfer belt 31 and toner and to suppress the scattering of toner on the intermediate transfer belt 31 in an area from the first transfer positions T to the second transfer position NT.

More specifically, in the case of a single color toner, the transfer efficiency at the second transfer position NT is enhanced.

The adhesion force of the toner of the topmost layer with the intermediate transfer belt 31 is small since they are not in contact with each other. Accordingly, the toner of the topmost layer can be transferred to a recording medium P at the second transfer position NT. The charge amount of toner of the bottommost layer is small due to the charge-reducing function of the first charge-amount adjusting devices 50. Accordingly, the toner of the bottommost layer is properly transferred to a recording medium P at the second transfer position NT. In this manner, the second charge-amount adjusting device 56 does not impair the transferring of toner to a recording medium P.

An operation of this exemplary embodiment will be described below.

Upon receiving an image forming command (print command), the controller 70 operates the toner image forming units 20Y, 20M, 20C, and 20K (and toner image forming units 20V and 20G, if necessary), the transfer device 30, and the fixing device 40 (see FIG. 1).

Then, in the toner image forming units 20, toner images are formed by the following image forming steps (process). The photoconductor drum 21 of each toner image forming unit 20 is charged by the charging device 22 while it is rotating. The charged photoconductor drum 21 is exposed to light by the exposure device 23 so that an electrostatic latent image is formed on the surface of the photoconductor drum 21. The electrostatic latent image formed on each photoconductor drum 21 is developed by using a developer supplied from the developing device 24. As a result, Y, M, C, and K toner images are sequentially formed on the photoconductor drums 21 in order from the upstream side to the downstream side. If specific colors are applied, after V and G toner images are formed on the photoconductor drums 21 in order from the upstream side to the downstream side, Y, M, C, and K toner images are formed.

The toner images formed on the photoconductor drums 21 are sequentially transferred to the transfer image areas of the rotating intermediate transfer belt 31 and are superposed on each other by the first transfer rollers 33.

The toner images superposed on the intermediate transfer belt 31 are transported to the second transfer position NT in accordance with the rotation of the intermediate transfer belt 31.

A recording medium P is supplied to the second transfer position NT by the transport rollers 44 in accordance with a timing at which the toner images are transported to the second transfer position NT. When the recording medium P and the transfer image areas (superposed toner image areas) pass through the second transfer position NT, a second transfer voltage (voltage of the positive polarity) is applied to the second transfer roller 34. With the application of the second transfer voltage, the toner images are transferred from the intermediate transfer belt 31 to the recording medium P.

The recording medium P having the toner images thereon is transported from the second transfer position NT to the fixing device 40 by the transport belt 45, and the toner images on the recording medium P are fixed on the recording medium P by the fixing device 40. The recording medium P is then discharged by the transport belt 46.

Figure 6:
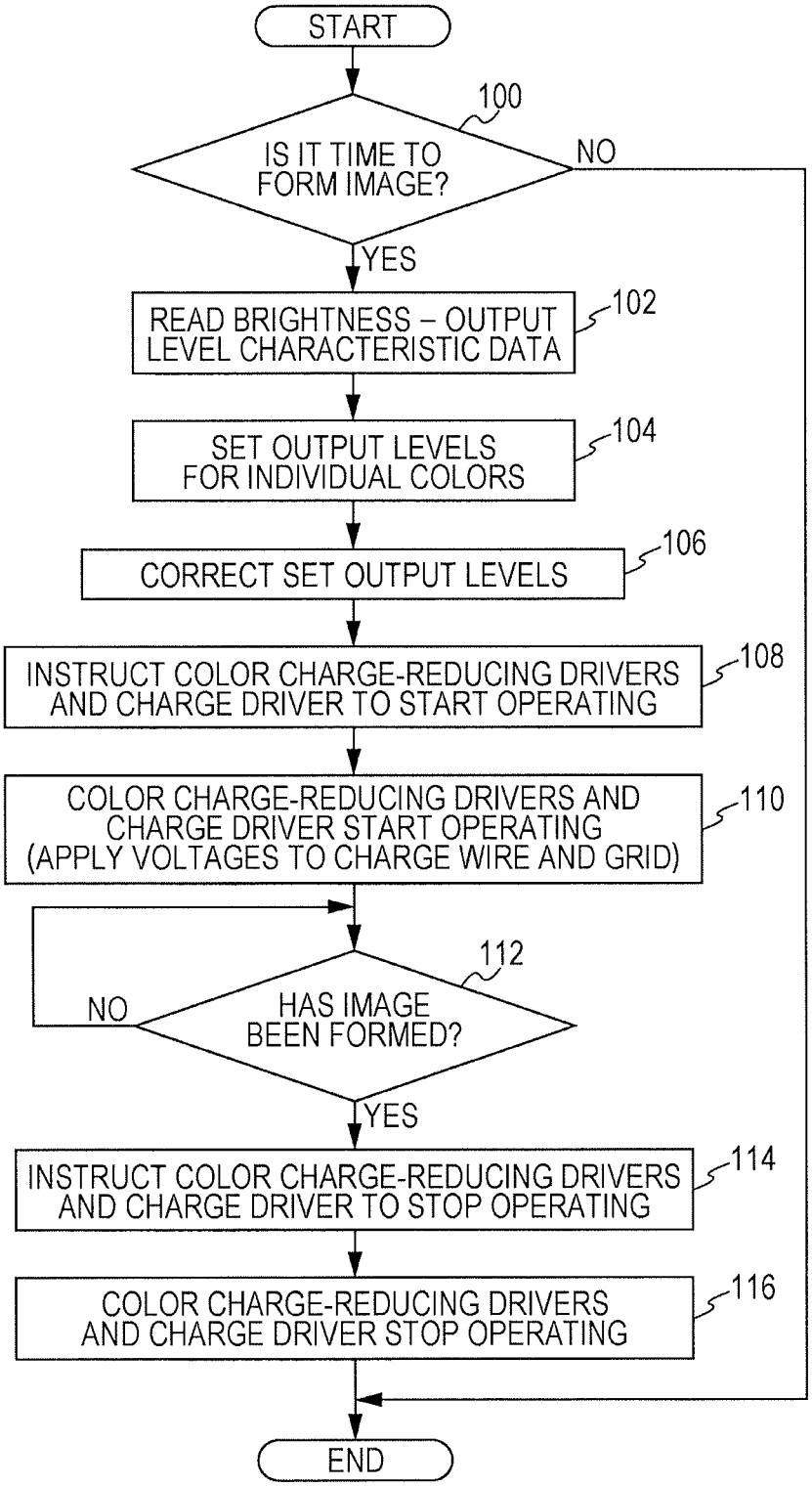
FIG. 6 is a flowchart illustrating a flow of a control operation performed by a controller for adjusting the charge amount of toner on an intermediate transfer belt by using the first and second charge-amount adjusting devices according to the exemplary embodiment.

FIG. 6 is a flowchart illustrating a flow of a control operation performed by the controller 70 for adjusting the charge amount of toner on the intermediate transfer belt 31 by using the first and second charge-amount adjusting devices 50 and 56.

In step 100, it is determined whether or not it is time to form an image. If the result of step 100 is NO, this routine is terminated. If the result of step 100 is YES, the process proceeds to step 102. In step 102, the brightness—output level characteristic data shown in FIG. 4 is read.

Then, in step 104, the output levels for the individual colors are set on the basis of the brightness—output level characteristic data.

Then, in step 106, the output levels for the individual colors set in step 104 are corrected on the basis of paper type information, temperature-and-humidity information, and first-transfer-roller resistance value information.

Concerning correction based on the paper type information, the output levels of the first charge-amount adjusting devices 50 are corrected on the basis of the paper type—output level characteristic diagram shown in FIG. 5A.

Concerning correction based on the temperature-and-humidity information, the output levels of the first charge-amount adjusting devices 50 are corrected on the basis of the humidity—output level characteristic diagram shown in FIG. 5B.

Concerning correction based on the resistance value of the first transfer rollers 33, the output levels of the first charge-amount adjusting devices 50 are corrected on the basis of the first-transfer-roller resistance value—output level characteristic diagram shown in FIG. 5C.

After finishing correcting the output levels in step 106, the process proceeds to step 108. In step 108, the output level instructing unit 68 instructs the color charge-reducing drivers 70 and the charge driver 72 to start operating. Then, in step 110, the color charge-reducing drivers 70 and the charge driver 72 start operating the first and second charge-amount adjusting devices 50 and 56. Then, in each of the first charge-amount adjusting devices 50, a voltage corresponding to the output level corrected in step 106 is applied to the charge wire 52A of the scorotron 52, while a uniform voltage is applied to the grid 52B. Similarly, in the second charge-amount adjusting device 56, voltages are applied to the charge wire and the grid of the scorotron 58.

In each of the first charge-amount adjusting devices 50, the charge amount of toner transferred to the intermediate transfer belt 31 (first transfer) is decreased. That is, the charge amount of toner is decreased by providing electric charge of the polarity (positive) opposite to the normal polarity (negative) of toner to toner.

On the other hand, in the second charge-amount adjusting device 56, the charge amount of toner is increased by providing electric charge of the same polarity as the normal polarity (negative) of toner to toner. The second charge-amount adjusting device 56 serves to restore the charge amount of single color toner from which electric charge has been reduced by the first charge-amount adjusting devices 50.

Then, in step 112, it is determined whether or not an image has been formed. If the result of step 112 is YES, the process proceeds to step 114. In step 114, the output level instructing unit 68 instructs the color charge-reducing drivers 70 and the charge driver 72 to stop operating. Then, in step 116, the color charge-reducing drivers 70 and the charge driver 72 stop operating the first and second charge-amount adjusting devices 50 and 56. Then, this routine is terminated.

First Modified Example

In the above-described exemplary embodiment, the first charge-amount adjusting device 50 is disposed in the downstream vicinity of each of the color toner image forming units 20. However, after the specifications of the image forming apparatus 10 have been determined and the arrangement of the toner image forming units 20 has been fixed, the first charge-amount adjusting device 50 may be selectively disposed for adjusting toner having a lower brightness level, as shown in FIG. 7.

Figure 7:
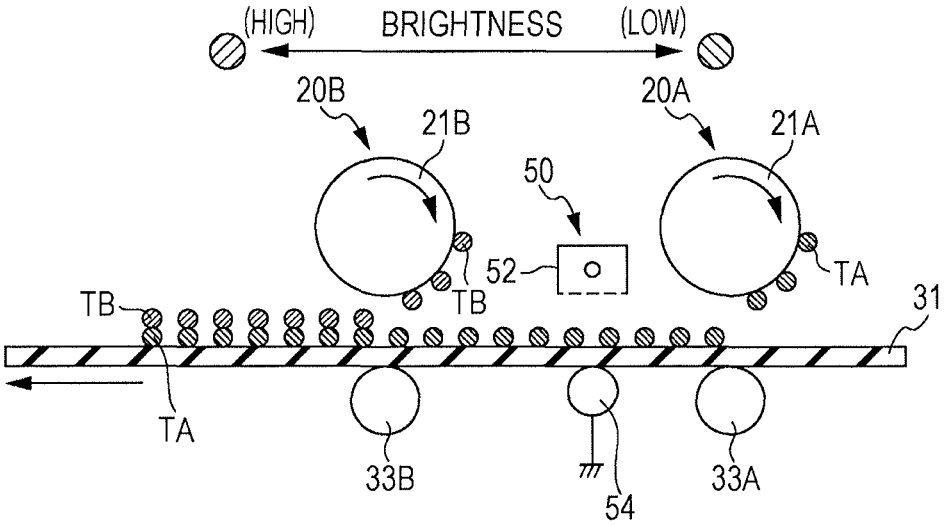
FIG. 7 is a front view of and near toner image forming units according to a first modified example.

In FIG. 7, two toner image forming units 20A and 20B using two toners TA and TB having different brightness levels are disposed along the transport direction of the intermediate transfer belt 31. In FIG. 7, only photoconductor drums 21A and 21B and first transfer rollers 33A and 33B are shown, and other components are omitted.

The brightness level of the toner TA applied to the toner image forming unit 20A on the upstream side is lower than that of the toner TB applied to the toner image forming unit 20B on the downstream side.

Accordingly, as shown in FIG. 7, the first charge-amount adjusting device 50 is disposed in the downstream vicinity of the toner image forming unit 20A on the upstream side. In other words, the first charge-amount adjusting device 50 is not disposed in the downstream vicinity of the toner image forming unit 20B on the downstream side.

The toner TA transferred from the toner image forming unit 20A on the upstream side forms the bottom layer toner of the superposed toners on the intermediate transfer belt 31, and electric charge of the toner TA is increased due to separating discharge generated when the toner TA passes through the first transfer position T of the toner image forming unit 20B on the downstream side. However, the charge amount of toner TA has been reduced by the first charge-amount adjusting device 50. As a result, a transfer failure does not occur at the second transfer position NT.

Second Modified Example

In the above-described exemplary embodiment, the first charge-amount adjusting device 50 is disposed in the downstream vicinity of each of the color toner image forming units 20, and a voltage is applied to the charge wire 52A of the scorotron 52 on the basis of the predetermined output level (for example, see FIG. 4). However, after the specifications of the image forming apparatus 10 have been determined and the arrangement of the toner image forming units 20 has been fixed, it may be determined on the basis of the brightness level whether or not it is necessary to decrease the charge amount, and the function of the first charge-amount adjusting device 50 may be selectively turned ON or OFF, as shown in FIG. 8.

Figure 8:
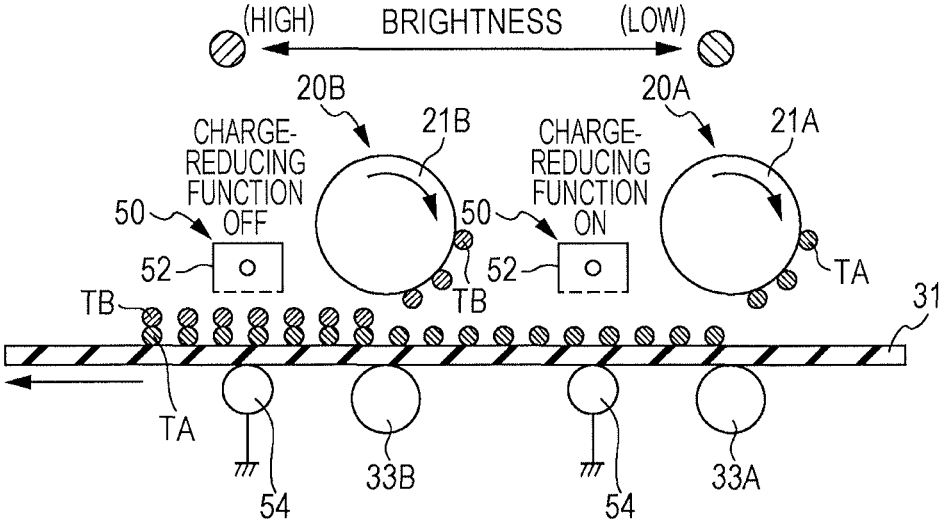
FIG. 8 is a front view of and near toner image forming units according to a second modified example.

In FIG. 8, two toner image forming units 20A and 20B using two toners TA and TB having different brightness levels are disposed along the transport direction of the intermediate transfer belt 31. In FIG. 8, only photoconductor drums 21A and 21B and first transfer rollers 33A and 33B are shown, and other components are omitted.

The brightness level of the toner TA applied to the toner image forming unit 20A on the upstream side is lower than that of the toner TB applied to the toner image forming unit 20B on the downstream side.

Accordingly, as shown in FIG. 8, the function of the first charge-amount adjusting device 50 disposed in the downstream vicinity of the toner image forming unit 20A on the upstream side is turned ON. On the other hand, the function of the first charge-amount adjusting device 50 disposed in the downstream vicinity of the toner image forming unit 20B on the downstream side is turned OFF.

The toner TA transferred from the toner image forming unit 20A on the upstream side forms the bottom layer toner of the superposed toners on the intermediate transfer belt 31, and electric charge of the toner TA is increased due to separating discharge generated when the toner TA passes through the first transfer position T of the toner image forming unit 20B on the downstream side. However, the charge amount of toner TA has been reduced by the first charge-amount adjusting device 50. As a result, a transfer failure does not occur at the second transfer position NT.

In the second modified example, if the order of the brightness levels of toners based on the arrangement of the toner image forming units 20 is changed due to specification changes, the output levels may be adjustable by turning ON or OFF the functions of the first charge-amount adjusting devices 50. For example, it is assumed that the brightness level of toner applied to the toner image forming unit 20B has become lower than that of toner applied to the toner image forming unit 20A.

In this case, the functions of the first charge-amount adjusting devices 50 may be turned ON or OFF in accordance with the brightness level of toner applied to a toner image forming unit 20 (not shown in FIG. 8) on the farther downstream side than the toner image forming unit 20B.

Third Modified Example

In the above-described exemplary embodiment, the first charge-amount adjusting device 50 is disposed in the downstream vicinity of each of the color toner image forming units 20, and a voltage is applied to the charge wire 52A of the scorotron 52 on the basis of a predetermined output level (for example, see FIG. 4). However, after the specifications of the image forming apparatus 10 have been determined and the arrangement of the toner image forming units 20 has been fixed, the output level may be set to be uniform, and the distances from the scorotrons 52 of the first charge-amount adjusting devices 50 to the intermediate transfer belt 31 may be changed, as shown in FIG. 9.

Figure 9:
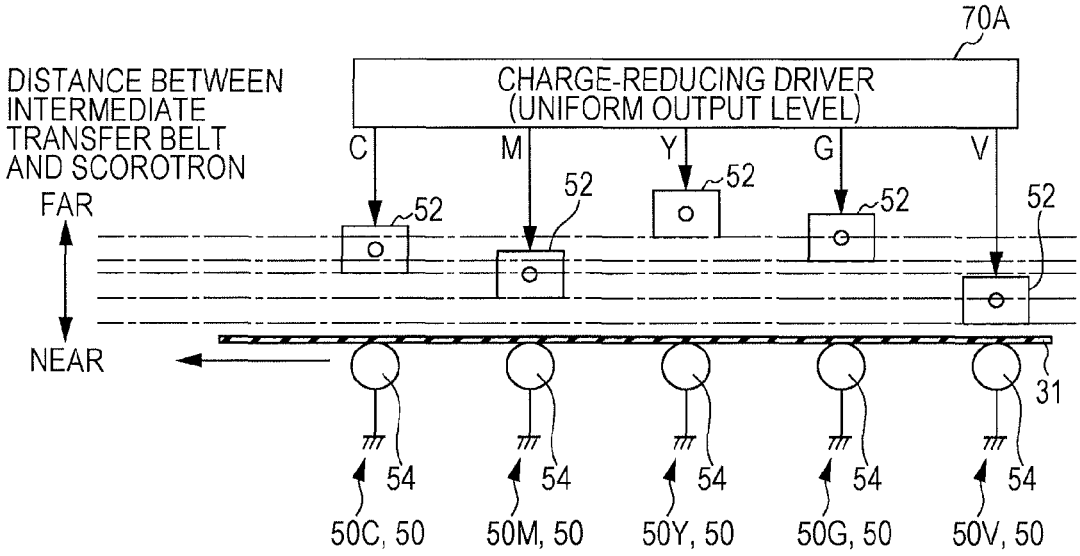
FIG. 9 is a front view illustrating the arrangement state of scorotrons of first charge-amount adjusting devices according to a third modified example.

FIG. 9 shows that the heights of the scorotrons 52 of the first charge-amount adjusting devices 50 (distances from the scorotrons 52 to the intermediate transfer belt 31) are changed in accordance with the brightness—output level characteristic data shown in FIG. 4.

As shown in FIG. 9, a charge-reducing driver 70A is used for all the first charge-amount adjusting devices 50, and the output level of the charge-reducing driver 70A is set to be uniform. Since the output level is uniform, the degree by which the scorotron 52 provides electric charge to toner on the intermediate transfer belt 31 is proportional to the distance from the scorotron 52 to the intermediate transfer belt 31. In this case, as the distance is smaller, the amount of electric charge provided to toner is greater. Accordingly, on the basis of the brightness—output level characteristic data shown in FIG. 4, a first charge-amount adjusting device 50Y for Y toner is positioned farthest from the intermediate transfer belt 31, and a first charge-amount adjusting device 50V for V toner is positioned closest from the intermediate transfer belt 31.

Fourth Modified Example

In the above-described exemplary embodiment, the first charge-amount adjusting device 50 is disposed in the downstream vicinity of each of the color toner image forming units 20. However, as shown in FIG. 10, the provision of first charge-amount adjusting devices 50 may be omitted.

Figure 10:
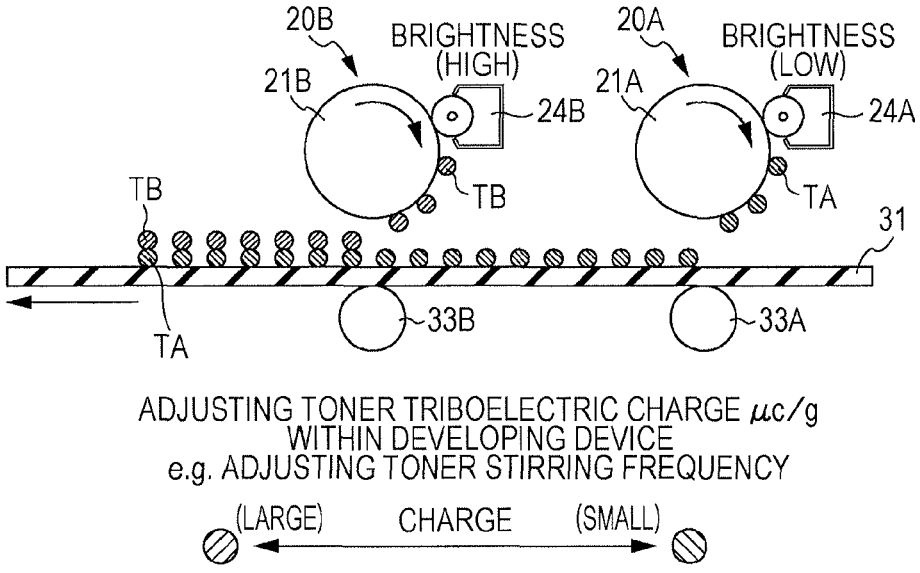
FIG. 10 is a front view of toner image forming units for adjusting the charge amount of toner by adjusting the frequency with which toner is stirred according to a fourth modified example.

In FIG. 10, two toner image forming units 20A and 20B using two toners TA and TB having different brightness levels are disposed along the transport direction of the intermediate transfer belt 31. In FIG. 10, only photoconductor drums 21A and 21B, developing devices 24A and 24B, and first transfer rollers 33A and 33B are shown, and other components are omitted.

The brightness of the toner TA applied to the toner image forming unit 20A on the upstream side is lower than that of the toner TB applied to the toner image forming unit 20B on the downstream side.

Accordingly, as shown in FIG. 10, the frequency with which the toner TA is stirred (toner stirring frequency) by the developing device 24A of the image forming unit 20A on the upstream side is set to be lower than that by the developing device 24B of the image forming unit 20B on the downstream side or to be lower than a reference toner stirring frequency. As the toner stirring frequency is higher, the charge amount of toner is increased, in other words, the charge amount of toner per gram is increased.

The toner TA transferred from the toner image forming unit 20A on the upstream side forms the bottom layer toner of the superposed toners on the intermediate transfer belt 31, and the charge amount of toner TA is increased due to separating discharge generated when the toner TA passes through the first transfer position T of the toner image forming unit 20B on the downstream side. However, since the stirring frequency for toner TA has been decreased, the charge amount of toner TA per gram is small. As a result, a transfer failure does not occur at the second transfer position NT.

Instead of adjusting the charge amount of toner per gram by using the developing devices 24A and 24B, the charge amount of toner per gram may be adjusted by another measure, for example, by charging toner on the photoconductor drums 21A and 21B.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of developing units configured to supply charged developers to electrostatic latent images formed on a plurality of associated image carriers which are disposed along a direction in which an intermediate transfer body is transported;

a plurality of first transfer units configured to transfer the associated developers onto the intermediate transfer body when the intermediate transfer body passes the associated image carriers while being transported so as to superpose the developers on each other;

a second transfer unit configured to transfer the superposed developers which are transferred onto the intermediate transfer body by the plurality of first transfer units onto a recording medium; and a scorotron and a roller configured to decrease an amount of electric charge of a developer based on and inversely proportional to a brightness level of the developer, wherein a brightness level of a lower layer developer being lower than a brightness level of a developer which forms an upper layer developer among the superposed developers, and wherein the developer forms the lower layer developer among the superposed developers transferred onto the intermediate transfer body by the first transfer units.

2. The image forming apparatus according to claim 1, wherein the scorotron and the roller form an electric-charge providing member that provides electric charge of a polarity opposite to a polarity of electric charge of a developer and that is disposed in the downstream vicinity of at least one of the plurality of image carriers.

3. The image forming apparatus according to claim 2, wherein the scorotron is a corona discharge member that is disposed near a surface of the intermediate transfer body on which developers are superposed on each other with a distance between the corona discharge member and the intermediate transfer body, and the roller is a ground member that is disposed in contact with a surface of the intermediate transfer body opposite to the surface on which developers are superposed on each other, and wherein the image forming apparatus includes a corona discharge power supply that supplies a voltage in which an alternating current voltage component is superposed on a direct current voltage component.

4. The image forming apparatus according to claim 3, wherein the corona discharge member adjusts the amount of electric charge on the basis of an output level of the corona discharge power supply.

5. The image forming apparatus according to claim 3, wherein an output level of the corona discharge power supply is set to be uniform, and the corona discharge member adjusts the amount of electric charge by varying the distance between the corona discharge member and the intermediate transfer body.

6. The image forming apparatus according to claim 1, wherein:

the scorotron and the roller form an electric-charge providing member provides electric charge of a polarity opposite to a polarity of electric charge of a developer and is disposed in the downstream vicinity of an image carrier using a developer which forms a lower layer developer among the superposed developers on the intermediate transfer body, a brightness level of the lower layer developer being lower than a brightness level of a developer which forms an upper layer developer among the superposed developers; and the electric-charge providing member provides electric charge to the developer which forms the lower layer developer after the developer is transferred onto the intermediate transfer body and before the developer which forms the upper layer developer is transferred onto the intermediate transfer body.

7. The image forming apparatus according to claim 6, wherein, after the developer which forms the upper layer developer is transferred onto the intermediate transfer body, the scorotron and the roller provide electric charge of a polarity opposite to a polarity of electric charge of the developer which forms the upper layer developer to the developer which forms the upper layer developer.

8. The image forming apparatus according to claim 1, wherein:

the scorotron and the roller form an electric-charge providing member that provides electric charge of a polarity opposite to a polarity of electric charge of a developer and that is disposed in the downstream vicinity of each of the plurality of image carriers; and an electric-charge providing member that is disposed in the downstream vicinity of an image carrier using a developer which forms a lower layer developer among the superposed developers on the intermediate transfer body, a brightness level of the developer which forms the lower layer developer being lower than a brightness level of a developer which forms an upper layer developer among the superposed developers, is selected, and the selected electric-charge providing member provides electric charge to the developer which forms the lower layer developer.

9. The image forming apparatus according to claim 1, wherein:

the scorotron and the roller form an electric-charge providing member that provides electric charge of a polarity opposite to a polarity of electric charge of a developer and that is disposed in the downstream vicinity of each of the plurality of image carriers; and the electric-charge providing member provides electric charge of a polarity opposite to a polarity of electric charge of a developer so that an amount of electric charge provided to a developer having a relatively low brightness level will be greater than an amount of electric charge provided to a developer having a relatively high brightness level.

10. The image forming apparatus according to claim 1, wherein the scorotron and the roller form a pre-transfer charge-amount adjusting unit configured to adjust the amount of electric charge of a developer which has not been transferred onto the intermediate transfer body.

11. The image forming apparatus according to claim 10, wherein the pre-transfer charge-amount adjusting unit is further configured to adjust the amount of electric charge by stirring a developer in each of the plurality of developing units or by charging a developer on each of the plurality of image carriers.

12. The image forming apparatus according to claim 1, further comprising:

a humidity sensor that detects the humidity at least of an area in which an image forming unit which transfers a developer and the intermediate transfer body are disposed; and a first correcting unit configured to correct the amount of electric charge of a developer adjusted by the charge-amount adjusting unit, on the basis of a detection result of the humidity sensor, so that the amount of electric charge of the developer will be adjusted by a greater degree as the humidity detected by the humidity sensor is lower.

13. The image forming apparatus according to claim 1, further comprising:

a first correcting unit configured to correct the amount of electric charge of a developer adjusted by the charge-amount adjusting unit so that the amount of electric charge of the developer will be adjusted by a greater degree as a resistance value which changes an applied voltage based on constant current control in an equivalent circuit of each of the plurality of first transfer units is higher.

14. The image forming apparatus according to claim 1, wherein, after the scorotron and the roller adjust the amount of electric charge of a developer and before the developer is transferred onto a recording medium by the second transfer unit, electric charge of the same polarity as a polarity of electric charge of a developer is provided so as to adjust an amount of electric charge of a single layer developer and an amount of electric charge of an upper layer developer.

15. The image forming apparatus according to claim 1, wherein the plurality of developing units are arranged in an order based on the brightness level of the developer supplied by each of the plurality of developing units.

16. The image forming apparatus according to claim 1, wherein the upper layer developer is arranged closer to the second transfer unit that the lower layer developer.

17. The image forming apparatus according to claim 1, wherein the scorotron and the roller are further configured to decrease the amount of electric charge based on both a color and a type of paper onto which the color is developed.

18. The image forming apparatus according to claim 1, further comprising:

a second scorotron and second roller configured to decrease a second amount of charge of a second developer, having a brightness level greater than the brightness level of the developer, the decrease of the second amount being less than the decrease of the amount; and a third scorotron and third roller configured to decrease a third amount of charge of a third developer, having a brightness level greater than the brightness level of the second developer, the decrease of the third amount being less than the decrease of the second amount;

a fourth scorotron and fourth roller configured to decrease a fourth amount of charge of a fourth developer, having a brightness level greater than the brightness level of the third developer, the decrease of the fourth amount being less than the decrease of the third amount;

a fifth scorotron and fifth roller configured to decrease a fifth amount of charge of a fifth developer, having a brightness level greater than the brightness level of the fourth developer, the decrease of the fifth amount being less than the decrease of the fourth amount.

19. An image forming method comprising:

supplying charged developers to electrostatic latent images formed on a plurality of associated image carriers which are disposed along a direction in which an intermediate transfer body is transported;

transferring the associated developers onto the intermediate transfer body when the intermediate transfer body passes the associated image carriers while being transported so as to superpose the developers on each other;

transferring the superposed developers which are transferred onto the intermediate transfer body onto a recording medium; and decreasing an amount of electric charge of a developer based on and inversely proportional to a brightness level of the developer, wherein a brightness level of a lower layer developer being lower than a brightness level of a developer which forms an upper layer developer among the superposed developers, and wherein the developer forms the lower layer developer among the superposed developers transferred onto the intermediate transfer body by the first transfer units.

* * * * *